US005906304A

United States Patent [19]

Baldacchino

[11] Patent Number: 5,906,304

[45] Date of Patent: May 25, 1999

[54] WATER SPORT EQUIPMENT RACK

[76] Inventor: Dominic Baldacchino, 8838 Heathermist Way, Elk Grove, Calif. 95624

[21] Appl. No.: 08/961,388

[22] Filed: Oct. 30, 1997

[51] Int. Cl.[6] ..... B60R 7/00

[52] U.S. Cl. ..... 224/406; 224/401; 224/543; 224/546

[58] Field of Search ..... 224/406, 401, 224/402, 403, 405, 543, 546, 539, 545

[56] References Cited

U.S. PATENT DOCUMENTS

| | | | |
|---|---|---|---|
| 2,797,851 | 7/1957 | Leake | 224/546 |
| 3,291,427 | 12/1966 | Hutchings | 224/406 |
| 3,811,143 | 5/1974 | Page . | |
| 3,925,836 | 12/1975 | Simmonds . | |
| 4,056,220 | 11/1977 | Trimble . | |
| 4,234,112 | 11/1980 | Gallant . | |
| 4,330,065 | 5/1982 | Haddad . | |
| 4,582,015 | 4/1986 | Hunter . | |
| 4,858,802 | 8/1989 | Hamby et al. . | |
| 4,863,082 | 9/1989 | Evans et al. . | |
| 5,105,754 | 4/1992 | Collins . | |

*Primary Examiner*—David J. Walczak
*Attorney, Agent, or Firm*—James M. Ritchey

[57] ABSTRACT

A rack that adjustably attaches to an inboard wall panel of a boat for securing water sport equipment in the cockpit of the boat. The device is configured so that the rack adjustably attaches to the inboard wall panel and rests flush against the floor of a boat. The device is designed to secure a variety of water sport equipment so as to protect the water sport equipment, the boat and the passengers.

9 Claims, 5 Drawing Sheets

WATER SPORT EQUIPMENT RACK

BACKGROUND OF THE INVENTION

1. Field of the Invention

A water sport equipment rack for safe and secure transport in a boat is provided. More specifically, a rack is disclosed that is designed to hold various water sport equipment and to attach to the inside wall panel of a boat by an adjustable apparatus to improve the method of supporting and stabilizing the water sport equipment and to protect the water sport equipment, the boat, and the passengers.

2. Description of the Background Art

Water sports have become, with increasing participation, a popular sport for competition and recreation. With a variety of water sport equipment now available to be used in connection with a boat, an adequate holding device to accommodate the variety of water sport equipment is necessary to provide storage, support and stability to the equipment and to provide protection and safety to the equipment, the boat, and the passengers.

Many new models of boats now have provisions for the storage of the current variety of water sport equipment. However, older models and some new models of boats do not have provisions for storage; consequently, the water sport equipment is loosely placed in the boat, often on the floor, posing a harm to the equipment, the boat, or the passengers.

Several racks for storage of water sport equipment have been devised in the past for securement of the equipment on a boat during transport. However, none has been devised to attach to the inboard wall panel, and none is devised to accommodate the current variety of water sport equipment now available.

U.S. Pat. No. 3,811,143 introduces a water ski holder that mounts to an engine of an inboard motor boat. The disclosed rack is devised to store water skis on the rack above the engine. A resilient member straps over the water skis to secure them in place. The rack also includes a hook for attachment of a tow rope.

Disclosed in U.S. Pat. No. 3,925,836 is a ski rack that mounts on the exterior transom of a boat. This invention is a rack that extends upward over the outboard engine and secures water skis outside of the cockpit of a boat.

U.S. Pat. No. 4,056,220 presents a portable device for storage of water skis and tow ropes. The portable device mounts on the transom of a boat, extending out of the cockpit of the boat.

A ski rack is introduced in U.S. Pat. No. 4,234,112 having tubular posts that mount, by means of suction cups, to the horizontal top and vertical side external surfaces of a boat, thus exterior to the cockpit. The rack is devised to hold up to two pairs of water skis that would stack on top of the other.

Disclosed in U.S. Pat. No. 4,330,065 is a portable water ski rack. The disclosed portable rack is intended to be mounted over the boat engine with securement of the rack to either the engine or the boat frame. The disclosed rack is also designed only for securement of water skis, and not other current water sport equipment.

Related in U.S. Pat. No. 4,582,015 is a rack for supporting water skis exterior to the cockpit of a boat. The rack has a pair of support members that attach to the gunwale of the boat with the support members extending outside the side of the boat.

A water ski storage rack is disclosed in U.S. Pat. No. 4,858,802. The disclosed rack is devised as a V-shaped support for water skis and the like that resiliently connects to a lower support element. The rack is intended to be mounted on a boat, outside of the cockpit. The rack supports water skis and the like by stacking a set of skis on top of the other.

U.S. Pat. No. 4,863,082 discloses a lockable water ski rack having a lower support base hinged to an upper support frame that closes and locks the water skis in place. This rack mounts to the gunwale or transom of a boat, outside of the cockpit. The rack is intended to hold water skis and the tow rope.

U.S. Pat. No. 5,105,754 discloses a water ski rack fashioned with support legs that position over and attach to the boat engine cover. The disclosed rack is devised to be utilized as an apparatus to secure water skis and to be utilized as a tow hook for use in towing a skier. The disclosed rack is devised only to secure water skis and not other current water sport equipment.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teaches or renders obvious, singly or when considered in combination, applicant's claimed invention.

SUMMARY OF THE INVENTION

An object of the present invention is to provide a rack for a variety of water sport equipment, including, but not limited to, a water ski, a wake board, a knee board, a tow rope handle, and a ski boom.

Another object of the present invention is to furnish a water sport equipment rack that provides storage, support, and stability to the equipment and to provide protection and safety to the equipment, the boat, and the passengers.

A further object of the present invention is to supply a water sport equipment rack that may be easily adjusted to mount, with few parts, to an inboard wall panel in the cockpit of a boat.

Still another object of the present invention is to disclose a water sport equipment rack that is mounted in an appropriate location that will not obstruct the view of the driver or the passengers of the boat and does not interfere with the path of the tow rope.

Yet a further object of the present invention is to describe a rack for the safe and secure storage of water sport equipment that is not necessary to remove when loading or covering the boat.

Disclosed is a water sport equipment rack comprising a rigid planar member having a horizontal edge, a vertical edge, and an opposing edge to the horizontal and the vertical edges. The opposing edge has slots for storage of a plurality of various water sport equipment. The rack has an adjustable attachment means to secure the vertical edge to an inboard wall panel with the horizontal edge flush to the floor in the cockpit of a boat. The rack also has a protective coating to avoid scratching the water sport equipment.

Further disclosed is a water sport equipment rack comprising a rigid planar member having a substantially quarter-circle shape wherein the quarter-circle planar member has a front side, a back side and an edge. The front side is attached to the back side by the edge. The edge further comprises a substantially horizontal edge having a first end and a second end; a substantially vertical edge having a first end and a second end, wherein the first horizontal edge end is attached to the first vertical edge end so that the horizontal edge and the vertical edge are substantially perpendicular; and a substantially arced edge opposing the horizontal and the vertical edges, wherein the arced edge has a first end attached to the second horizontal edge end and a second edge end attached to the second vertical edge end. The arced edge further comprises a plurality of slots wherein the slots have an open peripheral end and a closed medial end and the slots have a predetermined spacing and a predetermined length to adapt to various water sport equipment for secure and safe storage during transport in the boat. The slots further comprise a slot with substantially parallel edges to receive a water ski, a wake board, a knee board, and the like; a slot with substantially rounded edges to receive a tow rope handle; and a slot with substantially tapered edges to receive other water sport equipment such as a ski boom. The water sport equipment rack also comprises a protective covering to protect the water sport equipment from being scratched.

The water sport equipment rack further comprises a means for adjustable attachment to the inboard wall panel of the boat. The attachment means preferably, although not exclusively, is a clamp that adjustably attaches to the front and back side of the rigid planar member preferably proximate to the vertical edge and adjustably attaches to the inboard wall panel of the boat so that the vertical edge is aligned substantially flush to the inboard wall panel and the horizontal edge is aligned substantially flush to the floor of the boat thereby securing the water sport equipment rack in a fixed position. For another contemplated attachment means, the water sport equipment rack further comprises a groove on the front side of the quarter-circle rigid planar member that is substantially parallel to the vertical edge and a corresponding groove on the back side. The grooves on both front and back sides have at least one aperture for receiving an anchoring device, such as, but not limited to, a pin, a bolt, or a rod that may be, although not exclusively, connected to a clamp that adjustable attaches to the inboard wall panel, wherein the vertical edge aligns substantially flush to the inboard wall panel and the horizontal edge aligns substantially flush to the floor of the boat.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–4, there is shown a preferred embodiment of a rack for securing water sport equipment within a boat. The rack is usually, but not exclusively, utilized to secure a water ski, a wake board, a knee board, a tow rope handle, and a ski boom. Preferably, the rack is devised to function with a pair of planar members, substantially parallel to and at a predetermined distance apart from each other and substantially vertically mounted to the inboard wall panel of a boat. However, the rack is also contemplated to function with more than two planar members or with a single member having a wider or thicker edge. The rack is usually, although not exclusively, in the shape of a substantially quarter-circle shape as viewed from the front or back side. However, other shapes are contemplated such as, but not limited to, a triangular-like shape, a trapezoid-like shape or a rectangular-like shape. The rack may be fabricated from, but not limited to, a rigid material such as plastic, wood or fiberglass. The rack may also be fabricated from a buoyant material. The dimensions of the rack are predetermined to adapt to the variety of water sport equipment, boats, or fabrication material. Furthermore, the rack is usually, but not exclusively, attached to the inboard side wall panel of a boat, although other locations are contemplated. Additionally, the attachment means is usually a securing device, wherein the securing device is, but not exclusively, a clamp that adjustably attaches to the front and back side of the rigid planar member and adjustably attaches to the inboard side wall panel of the boat. Although other adjustable attachment means are contemplated including, but not exclusively, an anchoring pin, a bracket, VELCRO, or an adhesive.

Figure 1:
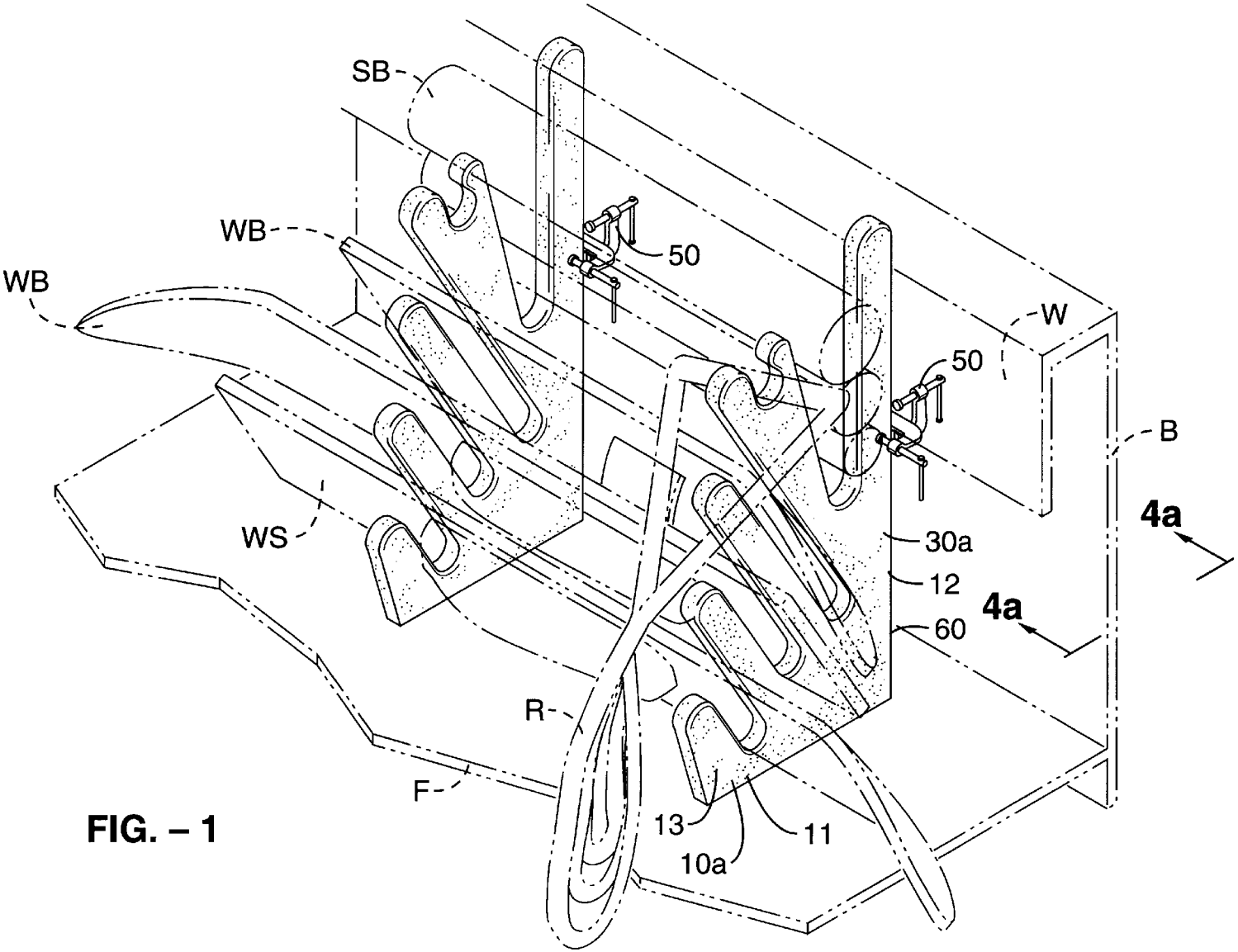
FIG. 1 is a perspective view of a boat on which the water sport equipment rack embodying the subject invention is installed.
Figure 2:
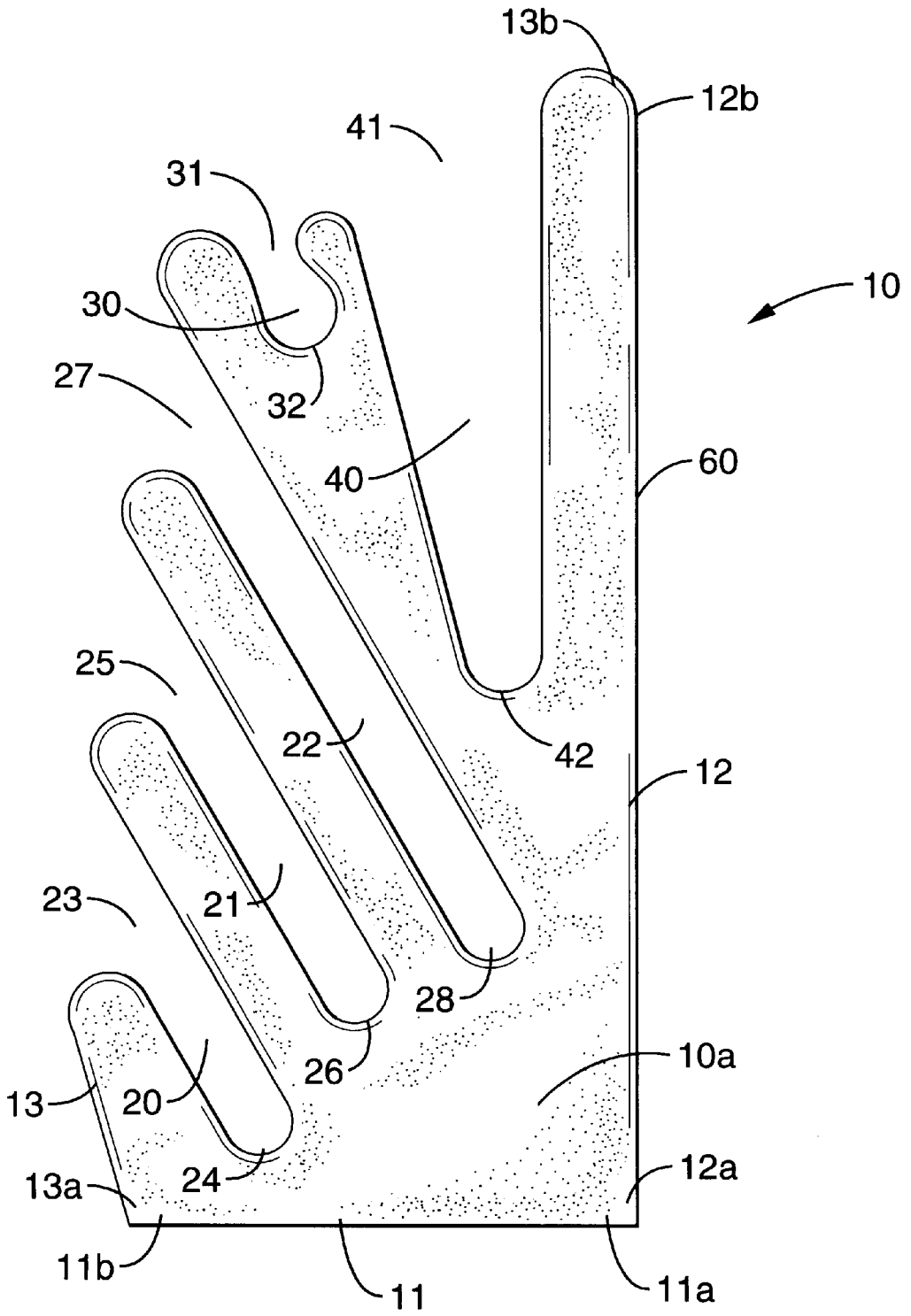
FIG. 2 is a front side view of the subject invention in a vertical position.
Figure 3:
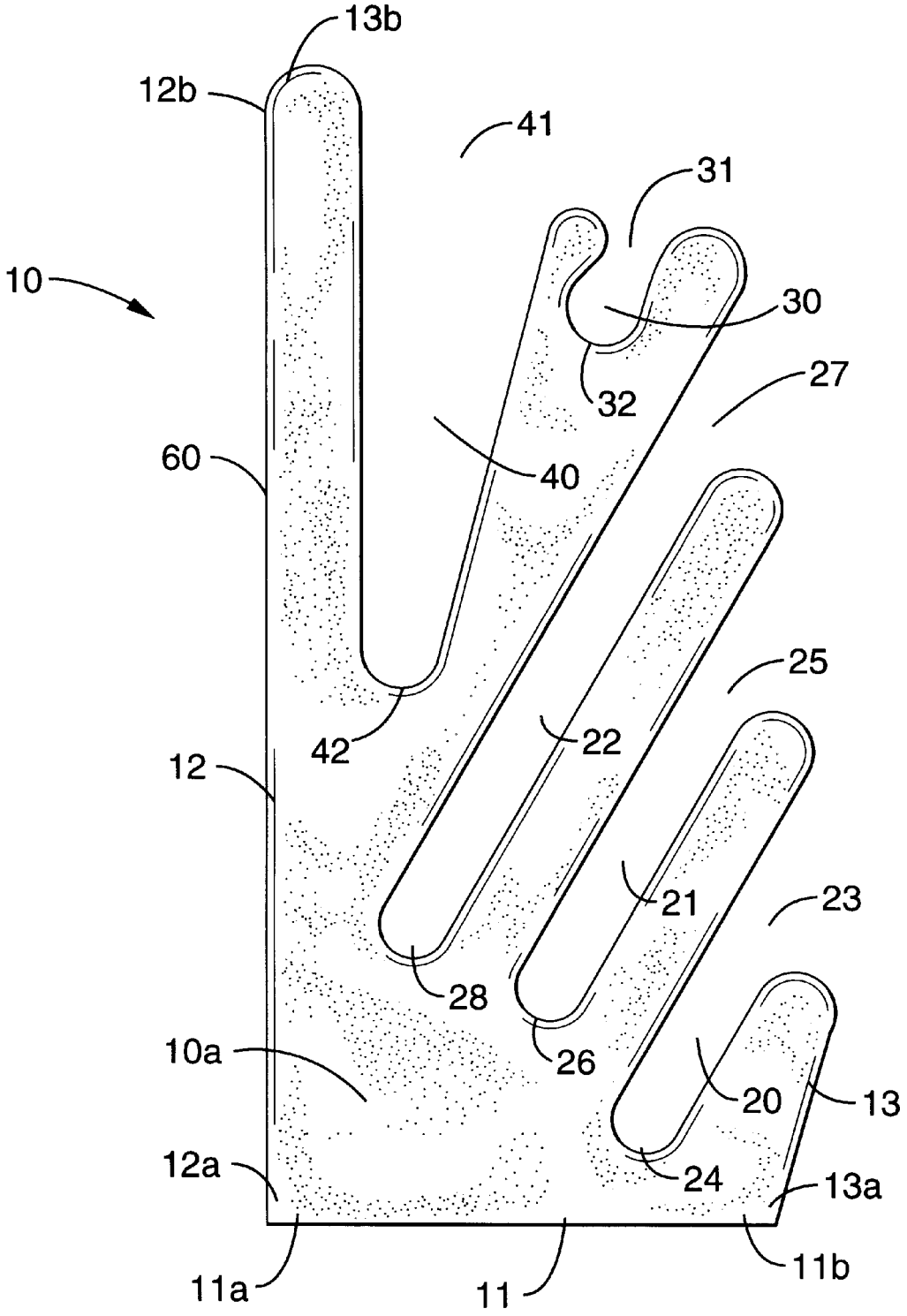
FIG. 3 is a back side view of the subject invention in a vertical position.

Comprising the subject invention of a water sport equipment rack is a rigid planar member 10, having a front side 10*a* and a back side 10*b*. The subject invention is described as having a quarter-circle shape from the front side 10*a* or back side 10*b* view, as seen in FIGS. 2 or 3, respectively. The front side 10*a* and the back side 10*b* of the rigid member 10 are joined by a horizontal edge 11, wherein the horizontal edge has a first end 11*a* and a second end 11*b*; a vertical edge 12 having a first end 12*a* and a second end 12*b*, wherein the first vertical edge end 12*a* joins the first horizontal edge end 11*a*; and an arced edge 13, having a first end 13*a* and a second end 13*b*, wherein the first arced edge end 13*a* joins the second horizontal edge end 11*b* and the second arced edge end 13*b* joins the second vertical edge end 12*b*.

Figure 4A:
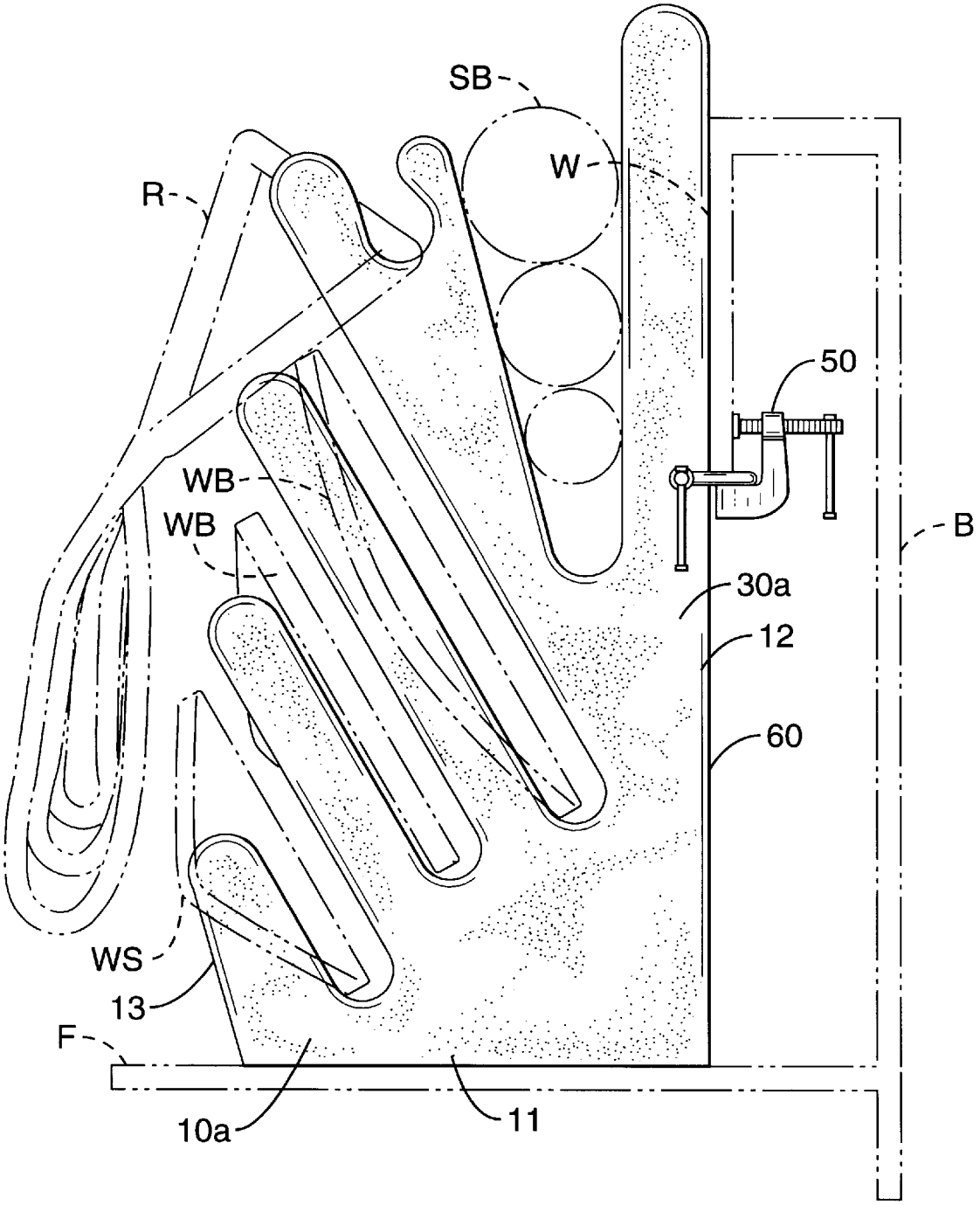
FIG. 4*a* is a sectional view taken along line 4*a*—4*a* of a portion of the boat shown in FIG. 1 showing the rack attached to an inboard side wall panel of the boat.
Figure 4B:
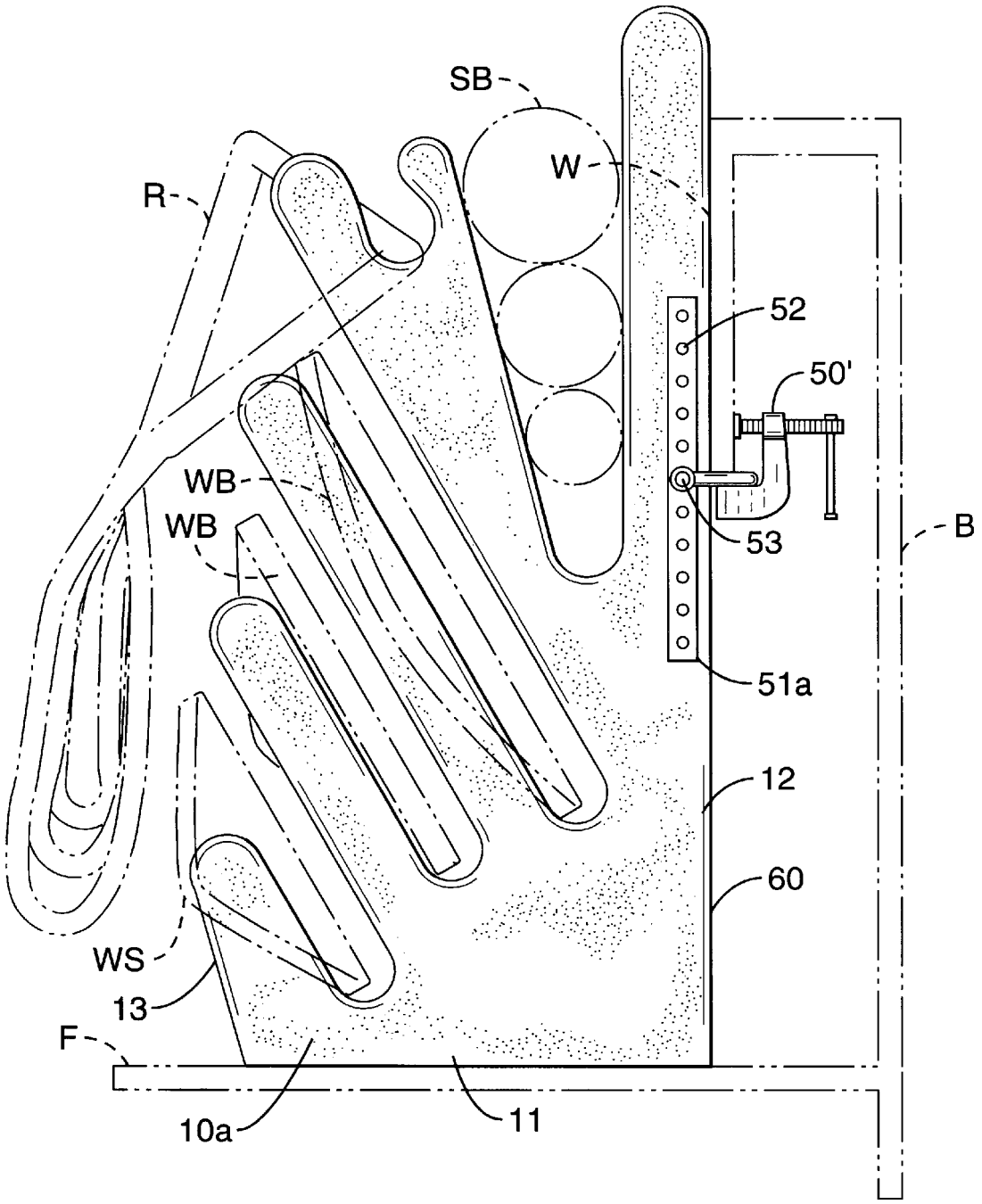
FIG. 4*b* is a sectional view taken along line 4*a*—4*a* of a portion of the boat shown in FIG. 1 showing an alternative attachment of the rack to an inboard side wall panel of the boat.

The arced edge 13 has at least one substantially, but not exclusively, parallel slot 20, 21, 22 preferably for holding a water ski WS, a wake board WB, a knee board (not shown, but usually held in the top slot because of its size), or the like; a substantially rounded slot 30 for holding a tow rope handle R; and a tapered slot 40 for holding a ski boom SB, as seen in FIGS. 4*a* and 4*b*. For storage of water sport equipment on this invention, slots 20, 21, 22, 30, and 40 each have an open peripheral end 23, 25, 27, 31, and 41 and a closed medial end 24, 26, 28, 32, and 42. The rack has a protective coating 60 over the rigid planar member 10 to avoid scratches to the water sport equipment.

The rigid planar member 10, as seen in FIG. 4*a*, is attached to an inboard side wall panel W of the boat B by a clamp 50. The clamp 50 adjustably attaches to the front side 10*a* and the back side 10*b* of the rigid planar member 10 preferably proximate to the vertical edge 12 and adjustably attaches to the inboard side wall panel W of the boat B so that the vertical edge 12 is aligned substantially flush to the inboard side wall panel W and the horizontal edge aligned substantially flush to the floor F of the boat B thereby securing the water sport equipment rack in a fixed position.

For a contemplated alternative means for attachment, the rigid planar member 10, as seen in FIG. 4*b*, has a groove 51 on the front side 10*a* with a corresponding groove (not shown) on the back side 10*b*. The grooves align substantially parallel to the vertical edge 12. The grooves also have at least one aperture 52 (the aperture usually extends from one groove to the other) to receive an anchoring means, wherein the anchoring means may be an anchoring pin 53 attached to a clamp 50 that adjustably attaches to the inboard side wall panel W, such that the vertical edge 12 aligns substantially flush to the inboard side wall panel W and the horizontal edge 11 aligns substantially flush to the floor F of the boat B.

For another alternative contemplated attachment means, the rigid planar member 10 may have a slot (not shown) of predetermined dimensions on the arced edge 13 proximate to the vertical edge 12; the slot (not shown) may receive the inboard wall panel W so that the rack 10 may be wedged between the floor F and the inboard wall panel W of the boat B.

The rigid planar member 10 may also have a support means (not shown) attached to the horizontal edge 11 to provide, as needed, additional support for stabilizing the rack when positioned in the boat (B); the support means (not shown) may include a base, a pedestal, Velcro™, or the like.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A water sport equipment rack for attachment in a boat, wherein the boat has an inboard compartment having a floor and a wall panel, the rack comprises:

a) a planar member, wherein said planar member further comprises:

i) a substantially horizontal edge, said horizontal edge having a first end and a second end;

ii) a substantially vertical edge, said vertical edge having a first end and a second end, wherein said first vertical edge end touches said first horizontal edge end; and iii) a substantially opposing edge, said opposing edge having a first end and a second end, wherein said first opposing edge end touches said second horizontal edge end and said second opposing edge end touches said second vertical edge end, wherein said opposing edge further comprises a plurality of slots, wherein said slots having an open peripheral end and a closed medial end, said slots having a predetermined spacing and a predetermined length, wherein said spacing and said length are adapted to receive water sport equipment therein for secure and safe transport, wherein said slots further comprise:

a slot with substantially parallel edges, said parallel edges having a predetermined spacing and a predetermined length, said spacing and said length sized to receive the water sport equipment for secure and safe transport;

a slot with substantially rounded edges, said rounded edges having a predetermined size to receive a ski rope handle for secure and safe transport; and a slot with substantially tapered edges, said tapered edges having a predetermined spacing and predetermined length to receive at least a ski boom for secure and safe transport; and b) means for enabling adjustable attachment of said planar member to the inboard wall panel of the boat.

2. A water sport equipment rack according to claim 1, wherein said adjustable attachment means comprises a securing device, wherein said securing device adjustably attaches to said planar member and is adapted to attach to the inboard wall panel of the boat.

3. A water sport equipment rack for a boat, wherein the boat has an inboard compartment having a floor and a wall panel, the rack comprises:

a) a planar member having a substantially quarter-circle shape, wherein said quarter-circle member further comprises a planar side having a front side, a back side, and an edge, wherein said front side is attached to said back side by said edge, wherein said edge further comprises:

i) a substantially horizontal edge, wherein said horizontal edge may be positioned flush with the floor of the boat, said horizontal edge having a first end and a second end;

ii) a substantially vertical edge, wherein said vertical edge may be positioned flush with the inboard wall panel of the boat, said vertical edge having a first end and a second end, wherein said first vertical edge end touches said first horizontal edge end; and iii) a substantially arced edge, wherein said arced edge has a first end and a second end, wherein said first arced edge end touches said second horizontal edge end and said second arced edge end touches said second vertical edge end, wherein said arced edge further comprises a plurality of slots, wherein said slots have an open peripheral end and a closed medial end, said slots having a predetermined spacing and a predetermined length, wherein said spacing and said length enable water sport equipment to be secure and safe during storage and transport; and b) adjustable attachment means for attachment of said quarter-circle member to the inboard wall panel of the boat.

4. A water sport equipment rack according to claim 3, wherein said slots further comprise:

a) a slot with substantially parallel edges, said parallel edges having a predetermined spacing and a predetermined length, said spacing and said length sized to receive the water sport equipment for secure and safe transport;

b) a slot with substantially rounded edges, said rounded edges having a predetermined size to receive a ski rope handle for secure and safe transport; and c) a slot with substantially tapered edges, said tapered edges having a predetermined spacing and a predetermined length to receive a ski boom for secure and safe transport.

5. A water sport equipment rack according to claim 4, wherein said attachment means comprises a clamp, wherein said clamp adjustably attaches to said front side and said back side of said planar member and said clamp is adapted to adjustably attach to the inboard wall panel of the boat.

6. A water sport equipment rack according to claim 4, wherein said front panel and said back panel both further comprise a corresponding groove running substantially parallel to said vertical edge.

7. A water sport equipment rack according to claim 6, wherein said groove further comprises at least one aperture for receiving an anchoring means.

8. A water sport equipment rack according to claim 4, wherein said rack further comprises a rigid material.

9. A water sport equipment rack according to claim 8, wherein said rack further comprises a protective covering.

* * * * *